US012576437B2

(12) United States Patent
Fujita et al.

(10) Patent No.: US 12,576,437 B2
(45) Date of Patent: Mar. 17, 2026

(54) COLD ROLLING FACILITY, COLD ROLLING METHOD, AND MANUFACTURING METHOD OF METAL PLATE

(71) Applicant: JFE STEEL CORPORATION, Tokyo (JP)

(72) Inventors: Noriki Fujita, Tokyo (JP); Miwa Ohashi, Tokyo (JP); Tetsuya Arakawa, Tokyo (JP); Yukihiro Matsubara, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 275 days.

(21) Appl. No.: 18/032,472

(22) PCT Filed: Jul. 1, 2021

(86) PCT No.: PCT/JP2021/024962

§ 371 (c)(1),
(2) Date: Apr. 18, 2023

(87) PCT Pub. No.: WO2022/091484

PCT Pub. Date: May 5, 2022

(65) Prior Publication Data

US 2023/0381844 A1 Nov. 30, 2023

(30) Foreign Application Priority Data

Oct. 29, 2020 (JP) ..... 2020-181050

(51) Int. Cl.
*B21B 45/02* (2006.01)
*B21B 13/02* (2006.01)

(52) U.S. Cl.
CPC ..... *B21B 45/0248* (2013.01); *B21B 13/02* (2013.01)

(58) Field of Classification Search
CPC ..... B21B 45/0248; B21B 45/0245; B21B 45/0251; B21B 45/0215; B21B 45/0218
See application file for complete search history.

(56) References Cited

U.S. PATENT DOCUMENTS 6,276,183 B1 8/2001 Benedetti et al.
2008/0087066 A1* 4/2008 Takahama ..... B21B 1/28 72/45
2020/0230673 A1* 7/2020 Fukushima ..... C21D 6/008

FOREIGN PATENT DOCUMENTS

DE 10 2018 209 863 A1 12/2019
JP 2005-297025 A 10/2005
(Continued)

OTHER PUBLICATIONS

Sep. 21, 2021 International Search Report issued in International Patent Application No. PCT/JP2021/024962.
(Continued)

*Primary Examiner* — Debra M Sullivan
(74) *Attorney, Agent, or Firm* — OLIFF PLC

(57) ABSTRACT

A cold rolling facility includes: a cold tandem mill including rolling stands; and a rolling supply system including a first rolling oil supply system configured to supply first emulsion rolling oil, and a second rolling oil supply system configured to supply second emulsion rolling oil, wherein mixed rolling oil obtained by mixing the first and the second emulsion rolling oil is supplied at least to a specific rolling stand among the rolling stands in such a manner as to satisfy the following formula (1), $0.6 \leq F2/F1 \leq 1.4$ (1), where F1 denotes first horizontal force acting in a rolling direction on a roll included in the specific rolling stand, and F2 denotes second horizontal force acting in a rolling direction on a roll included in an upstream side rolling stand arranged on an
(Continued)

upstream side of the specific rolling stand and neighboring with the specific rolling stand.

6 Claims, 3 Drawing Sheets

(56) References Cited

FOREIGN PATENT DOCUMENTS

| | | | | |
|---|---|---|---|---|
| JP | 2006-263772 | A | | 10/2006 |
| JP | 2007-152352 | A | | 6/2007 |
| JP | 2008-212940 | A | | 9/2008 |
| JP | 2008-212974 | A | | 9/2008 |
| JP | 2013099757 | A | * | 5/2013 |
| JP | 2020-138218 | A | | 9/2020 |

OTHER PUBLICATIONS

Mar. 13, 2024 Extended Search Report issued in European Patent Application No. 21885607.8.

* cited by examiner

COLD ROLLING FACILITY, COLD ROLLING METHOD, AND MANUFACTURING METHOD OF METAL PLATE

FIELD

The present invention relates to a cold rolling facility, a cold rolling method, and a manufacturing method of a metal plate.

BACKGROUND

Generally, when a rolling object material such as a steel plate is cold-rolled using rolling rolls, rolling oil is supplied to the rolling rolls. The rolling oil plays a role as a lubricant agent (lubricating oil) for reducing friction generated between the rolling object material and the rolling rolls. Moreover, the rolling oil also plays a role as a cooling agent for cooling the rolling object material and the rolling rolls in such a manner that the temperatures of the rolling object material and the rolling rolls do not rise excessively due to friction heating or processing heating caused at the time of rolling. As supply methods of rolling oil that can be used at the time of cold rolling, there have been known a direct oiling method (direct method) that does not use rolling oil cyclically, and a circulating oiling method (recirculation method) that uses rolling oil cyclically.

Meanwhile, in recent years, there has been growing need for a thin and hard material, which has high strength and a thin gauge, for the purpose of fuel consumption suppression or the like that is to be caused by weight saving. Nevertheless, if rolling oil is fed using the conventional circulating oiling method at the time of high-load cold rolling, lubrication becomes insufficient, and mill vibration in a vertical direction that is called chattering sometimes occurs at a frequency of about 100 Hz to 200 Hz. If the chattering occurs, because a phenomenon in which the thickness of a rolling object material periodically varies becomes more likely to occur, the occurrence of chattering becomes a contributory factor of disturbing the productivity of high-value added products. From such backgrounds, Patent Literatures 1 and 2 propose methods of suppressing the occurrence of chattering attributed to lubrication insufficiency. Specifically, Patent Literatures 1 and 2 describe a hybrid lubricating method of a circulating oiling method of supplying first rolling oil, and a direct oiling method of supplying second rolling oil different from the first rolling oil. Patent Literatures 1 and 2 describe a method of controlling a final friction coefficient of a rolling stand to become a targeted friction coefficient by controlling a supply amount of the second rolling oil in the hybrid lubricating method.

Nevertheless, inventors of the present invention have perceived that a variation in thickness of a rolling object material occurs also by the method described in Patent Literatures 1 and 2. Then, the inventors have investigated the cause thereof, and have perceived that the variation is attributed to mill vibration in a horizontal direction (hereinafter, in this specification, "mill vibration in the horizontal direction" will be sometimes referred to as "horizontal vibration" or "chattering in the horizontal direction") that occurs at a frequency of several tens of Hz (about 30 to 100 Hz) lower than a frequency of mill vibration in the vertical direction. The occurrence cause of the horizontal vibration includes an increase in the number of 6-Hi rolling mills that occurs in response to recent high-load cold rolling required to accurately control the shape. In the 6-Hi rolling mill, a pair of upper and lower intermediate rolls are provided between a work roll and an auxiliary roll (backup roll).

Various rolls of the rolling mill are installed in left and right housings arranged on an operation side and a drive side, via roll chocks attached to their both ends in an axis line direction. At this time, to facilitate a replacement work of rolls, a clearance is provided between the roll chocks and the housings. Nevertheless, if rolling is performed in a state in which this clearance is left as-is, so-called backlash in which the position of a roll chock shifts due to force added to a roll at the time of rolling occurs. Thus, generally, to fill a clearance between a roll chock and a housing toward a one direction side, a work roll and an intermediate roll are arranged with an offset in the horizontal direction, and the position in the horizontal direction of the work roll is stabilized by causing part of rolling force to act in the horizontal direction. On the other hand, in a case where horizontal force exerted on the work roll is large due to high load, or backlash is not solved, a phenomenon in which the work roll vibrates in the horizontal direction, and a thickness periodically varies becomes more likely to occur.

CITATION LIST

Patent Literature

Patent Literature 1: JP 2006-263772 A
Patent Literature 2: JP 2013-99757 A
Patent Literature 3: JP 2007-152352 A

SUMMARY

Technical Problem

As means for solving the aforementioned horizontal vibration, it is considered to arrange a backlash absorbing device between a roll chock and a housing, to fill a clearance generated between the roll chock and the housing, toward one direction side, and roll a rolling object material while absorbing backlash (refer to Patent Literature 3). Nevertheless, because rolling oil is supplied by thousands of liters per minute in a cold tandem mill, even if the backlash absorbing device is arranged, horizontal vibration reoccurs due to deterioration or breakdown of the backlash absorbing device, and fundamental solution is not caused.

The present invention has been devised in view of the above-described problem, and the object is to provide a cold rolling facility and a cold rolling method that can suppress the occurrence of chattering in the horizontal direction. In addition, another object of the present invention is to provide a manufacturing method of a metal plate that can manufacture a metal plate with a good yield ratio.

Solution to Problem

The inventors of the present invention have earnestly considered a supply method of rolling oil for efficiently suppressing chattering in the horizontal direction in cold rolling. The inventors of the present invention have had knowledge indicating that chattering can be suppressed by appropriately keeping a balance of a rolling condition not only with a rolling stand serving as a generation source of the chattering, but also with a neighboring rolling stand on an upstream side, based on a certain standard, in the suppression of chattering in the vertical direction. In view of the foregoing, the inventors have considered, in more detail, a standard defining a rolling condition for suppressing chattering in the horizontal direction, and consequently conceived a technical idea indicating that chattering in the horizontal direction can be suppressed by keeping a ratio of horizontal forces of a roll that act on two neighboring rolling stands, within an appropriate range. The present invention has been devised based on such perception.

To solve the problem and achieve the object, a cold rolling facility according to the present invention includes: a cold tandem mill including a plurality of rolling stands; and a rolling supply system configured to supply rolling oil to the cold tandem mill, wherein the rolling supply system includes a first rolling oil supply system configured to supply first emulsion rolling oil, and a second rolling oil supply system configured to supply second emulsion rolling oil having a higher concentration than the first emulsion rolling oil, and wherein mixed rolling oil obtained by mixing the first emulsion rolling oil and the second emulsion rolling oil is supplied at least to a specific rolling stand among the plurality of rolling stands in such a manner as to satisfy the following formula (1).

$$0.6 \leq F2/F1 \leq 1.4 \quad (1),$$

where F1 denotes first horizontal force acting in a rolling direction on a roll included in the specific rolling stand, and F2 denotes second horizontal force acting in a rolling direction on a roll included in an upstream side rolling stand arranged on an upstream side of the specific rolling stand and neighboring with the specific rolling stand.

Moreover, in the cold rolling facility according to the present invention, in a case where the first horizontal force and the second horizontal force both exceed a predetermined standard value, the mixed rolling oil is supplied to both of the specific rolling stand and the upstream side rolling stand, and in a case where only the first horizontal force exceeds a predetermined standard value out of the first horizontal force and the second horizontal force, the mixed rolling oil is supplied to the specific rolling stand, and the mixed rolling oil is not supplied to the upstream side rolling stand.

Moreover, in the cold rolling facility according to the present invention, in a case where the first horizontal force and the second horizontal force both exceed a predetermined standard value, and in a case where only the first horizontal force exceeds a predetermined standard value out of the first horizontal force and the second horizontal force, the mixed rolling oil is supplied to the specific rolling stand, and the mixed rolling oil is not supplied to the upstream side rolling stand.

Moreover, a cold rolling facility according to the present invention includes: a cold tandem mill including a plurality of rolling stands; and a rolling supply system configured to supply rolling oil to the cold tandem mill, wherein the rolling supply system includes a first rolling oil supply system configured to supply first emulsion rolling oil, and a second rolling oil supply system configured to supply second emulsion rolling oil having a higher concentration than the first emulsion rolling oil, and wherein mixed rolling oil obtained by mixing the first emulsion rolling oil and the second emulsion rolling oil is supplied at least to a specific rolling stand among the plurality of rolling stands in such a manner as to satisfy the following formula (2).

$$0.6 \leq F3/F1 \leq 1.4 \quad (2),$$

where F1 denotes first horizontal force acting in a rolling direction on a roll included in the specific rolling stand, and F3 denotes third horizontal force identified based on a past rolling result of the specific rolling stand.

Moreover, a cold rolling method according to the present invention is a method for cold-rolling a rolling object material using the cold rolling facility according to the present invention.

Moreover, a manufacturing method of a metal plate according to the present invention is a method for manufacturing a metal plate by cold-rolling a rolling object material to be made into a metal plate, using the cold rolling method according to the present invention.

Advantageous Effects of Invention

According to the cold rolling facility and the cold rolling method according to the present invention, it is possible to suppress the occurrence of chattering in the horizontal direction. In addition, according to the manufacturing method of a metal plate according to the present invention, it is possible to manufacture a metal plate with a good yield ratio.

DESCRIPTION OF EMBODIMENTS

Hereinafter, a cold rolling facility, a cold rolling method, and a manufacturing method of a metal plate, which serve an embodiment of the present invention, will be described with reference to the drawings. Here, rolling oil used in the present embodiment may be either rolling oil of petroleum-based rolling oil and emulsion-based rolling oil. Nevertheless, because cold rolling oil in the iron and steel field is generally required to have high cooling performance, emulsion-based rolling oil (emulsion rolling oil) is often used as rolling oil. Thus, in the following embodiment, the description will be given using emulsion rolling oil (hereinafter, will be simply described as "emulsion") as an example of rolling oil.

Note that the emulsion refers to mixed liquid in a state in which particles of rolling oil are stably suspended in water. The property of emulsion is characterized by its concentration and average particle diameter. The concentration of emulsion is a ratio of an oil mass with respect to an emulsion total mass. In addition, the average particle diameter of emulsion is an average particle diameter of rolling oil in emulsion. In addition, to manufacture emulsion, it is necessary to add a surfactant and emulsify oil in water. An additive amount of the surfactant is a predetermined amount indicated by a mass concentration (oil concentration) with respect to a rolling oil amount. Then, after the surfactant is added, by adding shear using an agitator and a pump, an average particle diameter of emulsion is adjusted. Rolling oil (oil-in-water type rolling oil) obtained by diluting rolling oil to a concentration of about 1 to 5 mass % using warm water or the like, and being brought into an oil-in-water (O/W) emulsion state in which oil is dispersed in water, using a surfactant can be exemplified as emulsion rolling oil.

Configuration

Figure 1:
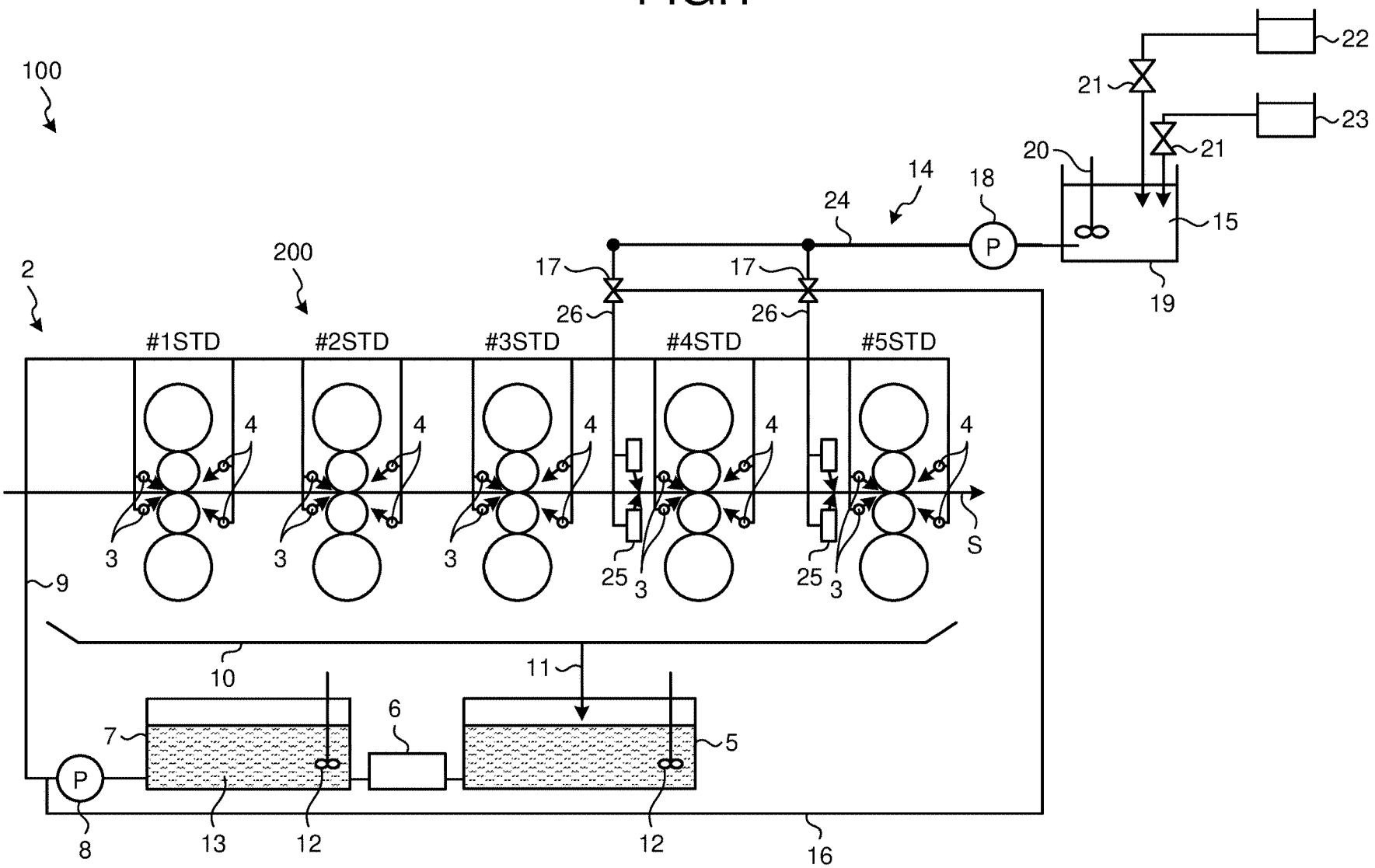
FIG. 1 is a schematic diagram illustrating a configuration of a cold rolling facility being an embodiment of the present invention.

First of all, a configuration of a cold rolling facility being an embodiment of the present invention will be described with reference to FIG. 1. FIG. 1 is a schematic diagram illustrating a configuration of a cold rolling facility being an embodiment of the present invention. Note that, in the following description, a steel plate S is used as an example of a rolling object material to be rolled by the cold rolling facility. Alternatively, an aluminum plate or another metal plate can be applied as a rolling object material.

As illustrated in FIG. 1, a cold rolling facility 100 being an embodiment of the present invention includes a cold tandem mill 200. The cold tandem mill 200 includes five rolling stands corresponding to first rolling to fifth rolling stands (#1STD to #5STD), in order from an input side of the steel plate S (left side of the paper surface in FIG. 1) toward an output side (right side of the paper surface in FIG. 1). In the cold tandem mill 200, a tension roll and a deflector roll, a plate thickness gauge, and a shape gauge, which are not illustrated in the drawing, are appropriately arranged between neighboring rolling stands. The configuration of the cold tandem mill 200, a conveyance device of the steel plate S, and the like are not specifically limited, and a known technique may be appropriately applied.

Emulsion rolling oil (in the following description, "emulsion rolling oil" will be simply referred to as "rolling oil") is supplied to each rolling stand of the cold tandem mill 200. In the present embodiment, a first rolling oil supply system 2 that supplies rolling oil to rolling stands, and a second rolling oil supply system 14 that supplies rolling oil to the fourth rolling stand (#4STD) and the fifth rolling stand (#5STD) are provided as rolling oil supply systems.

The cold rolling facility 100 includes a dirty tank (collection tank) 5 and a clean tank 7 as rolling oil storage tanks, and rolling oil stored in these rolling oil storage tanks is supplied to the rolling stands through the first rolling oil supply system 2 and the second rolling oil supply system 14. Rolling oil collected by an oil pan arranged below the rolling stands (i.e., rolling oil used in cold rolling) returns and flows into the dirty tank through a return pipe 11.

Rolling oil stored in the clean tank 7 is rolling oil formed by mixing warm water (dilution water) and (surfactant-added) undiluted solution of rolling oil. The mixed warm water and the undiluted solution of rolling oil are made into rolling oil having targeted desired average particle diameter and concentration range, by adjusting the number of rotations of an agitating blade of an agitator 12 (i.e., by adjusting an agitation degree). As the undiluted solution of rolling oil, undiluted solution used in normal cold rolling can be used. For example, undiluted solution of rolling oil that contains, as base oil, either of natural fat, fatty acid ester, and hydrocarbon series synthetic lubricating oil can be used. Furthermore, an additive agent used in normal cold rolling oil, such as an oiliness improver, an extreme-pressure additive, or an antioxidizing agent may be added to these types of rolling oil. In addition, as a surfactant added to rolling oil, whichever of an ionic surfactant and a non-ionic surfactant may be used, and it is sufficient that a surfactant used in a system of a normal circulating oiling method is used. Then, it is sufficient that undiluted solution of rolling oil is preferably diluted to a concentration of 2 to 8 mass %, and more preferably, to a concentration of 3 to 6.0 mass %, and moreover, made into O/W emulsion rolling oil in which oil is dispersed in water, using the aforementioned surfactant. Note that an average particle diameter thereof is preferably set to 15 μm or less, and more preferably to 3 to 10 μm.

After an operation start, rolling oil collected into the dirty tank 5 is supplied to the clean tank 7 via an iron powder removal device 6 including an iron powder amount control device and the like. Abrasion powder (iron power) generated by friction between a rolling roll and the steel plate S is mixed into the rolling oil collected into the dirty tank 5. Thus, the iron powder removal device 6 removes the abrasion powder in such a manner that oil-soluble iron in the collected rolling oil becomes oil-soluble iron allowable as rolling oil stored in the clean tank 7. The movement of emulsion rolling oil from the dirty tank 5 to the clean tank 7 via the iron powder removal device 6 may be continuously performed, or may be intermittently performed. As the iron powder removal device 6, an iron powder removal device that removes iron powder by absorbing iron powder using a magnetic filter such as an electromagnetic filter or a magnetic separator is preferably used, but the iron powder removal device 6 is not limited to this. The iron powder removal device 6 may be a known device that uses a method such as centrifugal separation.

Meanwhile, part of rolling oil supplied to the cold rolling facility 100 is taken out to the outside of the system via the steel plate S, or lost due to evaporation. Thus, a configuration of appropriately resupplying (supplying) undiluted solution of rolling oil from an undiluted solution tank (not illustrated) in such a manner that a storage level or a concentration of rolling oil in the clean tank 7 falls within a predetermined range is employed. In addition, warm water for dilution is also appropriately resupplied (supplied) to the clean tank 7. Note that a storage level or a concentration of first emulsion rolling oil 13 in the clean tank 7 can be measured by a sensor (not illustrated).

A rolling oil crude oil tank 22 and a warm water tank 23 are connected to an emulsion tank 19. Then, rolling oil crude oil stored in the rolling oil crude oil tank 22 and warm water stored in the warm water tank 23 are supplied into the emulsion tank 19 via a pump (not illustrated) and a flow rate control valve 21, and mixed by an agitator 20 in the emulsion tank 19. A condition of rolling oil in the emulsion tank 19 is preferably set to the same condition as a condition of rolling oil in the clean tank 7. In addition, an average particle diameter of second emulsion rolling oil 15 in the emulsion tank 19 is adjusted to 10 to 30 μm by adjusting the number of rotations of an agitating blade of the agitator 20, and a concentration thereof is adjusted to fall within the range of 3 to 20 mass %.

Next, the first rolling oil supply system 2 and the second rolling oil supply system 14 will be described in detail. Note that the first rolling oil supply system 2 and the second rolling oil supply system 14 both include a pump 8 for sucking up rolling oil from the dirty tank 5, the iron powder removal device 6, the clean tank 7, and the clean tank 7, and the first rolling oil supply system 2 and the second rolling oil supply system 14 are branched on the downstream side of the pump 8. In the following description, a configuration following a branch point will be mainly described. Note that a strainer for foreign body removal may be arranged between the clean tank 7 and the pump 8.

First Rolling Oil Supply System

The first rolling oil supply system 2 includes a first rolling oil pipe line 9 (first rolling oil supply line) having one end portion connected to the clean tank 7, and five sets of lubrication coolant headers 3 and five sets of cooling coolant header 4 that are branched at another end portion (rolling mill side) of the first rolling oil pipe line 9 and arranged at positions corresponding to the respective rolling stands. Each of the lubrication coolant headers 3 is arranged on an input side of a corresponding rolling stand, and supplies rolling oil serving as lubricating oil, to a roll bite and a work roll by spraying the rolling oil toward the roll bite from a spray nozzle provided in each the lubrication coolant headers 3. The cooling coolant header 4 is arranged on an output side of a rolling stand, and cools a rolling roll by spraying rolling oil toward the rolling roll from a spray nozzle provided in each of the cooling coolant headers 4.

With this configuration, in the first rolling oil supply system 2, rolling oil in the clean tank 7 is pressure-fed to the first rolling oil pipe line 9 by the pump 8. Hereinafter, rolling oil pressure-fed to the first rolling oil pipe line 9 and supplied to each rolling stand will also be referred to as the first emulsion rolling oil 13. The first emulsion rolling oil 13 is configured to be supplied through the first rolling oil pipe line 9 to the lubrication coolant header 3 and the cooling coolant header 4 arranged for each rolling stand, and sprayed from the respective spray nozzles provided in the lubrication coolant header 3 and the cooling coolant header 4. In addition, the first emulsion rolling oil 13 supplied to the rolling roll is collected by the oil pan 10, and returned to the dirty tank 5 through the return pipe 11 except for the first emulsion rolling oil 13 taken out to the outside of the system via the steel plate S or lost by evaporation. After that, part of emulsion rolling oil stored in the dirty tank 5 is returned into the clean tank 7 via the iron powder removal device 6 to remove a certain amount of oil-soluble iron in the emulsion rolling oil generated by cold rolling, as mentioned above.

With the above-described configuration of the first rolling oil supply system 2, rolling oil subjected to removal processing of abrasion powder is cyclically supplied to the rolling roll. In other words, the first emulsion rolling oil 13 is cyclically used. Here, the clean tank 7 corresponds to a rolling oil tank for circulation in the conventional circulating oiling method, and as mentioned above, undiluted solution of rolling oil is appropriately resupplied (supplied) to the clean tank 7.

Second Rolling Oil Supply System

The second rolling oil supply system 14 includes a second rolling oil pipe line 16 having one end portion connected to the first rolling oil pipe line 9, a third rolling oil pipe line 24 having one end portion connected to the emulsion tank 19, a flow rate control valve 17, a lubrication coolant header 25, and a mixed rolling oil pipe line 26 having one end connected to the flow rate control valve 17, and another end connected to the lubrication coolant header 25.

A rolling oil crude oil tank 22 and a warm water tank 23 are connected to an emulsion tank 19. Then, rolling oil crude oil stored in the rolling oil crude oil tank 22 and warm water stored in the warm water tank 23 are supplied into the emulsion tank 19 via a pump (not illustrated) and the flow rate control valve 21, and mixed by the agitator 20 in the emulsion tank 19. In the following description, rolling oil in the emulsion tank 19 will be sometimes referred to as the second emulsion rolling oil 15.

A temperature condition of the second emulsion rolling oil 15 is preferably set to the same condition as a temperature condition of the first emulsion rolling oil 13. However, from the viewpoint of improvement in cooling power of the steel plate S in a subsequent rolling stand, the temperature of the second emulsion rolling oil 15 may be set to a temperature lower than that of the first emulsion rolling oil 13 via a cooling device (not illustrated). In addition, a concentration condition and a particle diameter condition of rolling oil in the second emulsion rolling oil need not be the same as those of the first emulsion rolling oil 13.

The first emulsion rolling oil 13 stored in the clean tank 7 is supplied to the flow rate control valve 17 through the second rolling oil pipe line 16 by the driving of the pump 8. In addition, the second emulsion rolling oil 15 is supplied to the flow rate control valve 17 through the third rolling oil pipe line 24 by a pump 18. Then, the second emulsion rolling oil 15 is mixed with the first emulsion rolling oil 13 in the flow rate control valve 17, and mixed rolling oil containing the second emulsion rolling oil 15 having a predetermined emulsion concentration is formed. The mixed rolling oil are fed to the lubrication coolant headers 25 of the fourth and fifth rolling stands through the mixed rolling oil pipe lines 26. By being arranged with being branched to both of the front surface side and the rear surface side of the steel plate S, the lubrication coolant header 25 is configured to be able to spray mixed rolling oil at a desired concentration from a plurality of spray nozzles toward the both of the front and rear surfaces of the steel plate S. Subsequently, rolling oil collected by the oil pan 10 is cyclically used by being returned into the dirty tank 5 through the return pipe 11.

Note that the flow rate control valve 17 may control a flow rate of the second emulsion rolling oil 15 with respect to a flow rate of the first emulsion rolling oil 13. In addition, the second emulsion rolling oil 15 may be directly supplied to the steel plate S not via the flow rate control valve 17 included in a mixing unit, but more preferably, mixed oil of the first emulsion rolling oil 13 and the second emulsion rolling oil 15 is desirably supplied.

As described above, the flow rate control valve 17 includes a mixing unit that mixes the first emulsion rolling oil 13 and the second emulsion rolling oil 15. An aperture of the flow rate control valve 17 is adjusted in accordance with a command from a supply control unit 27 illustrated in FIG. 2, and a mix ratio of the first emulsion rolling oil 13 and the second emulsion rolling oil 15 is adjusted by the adjustment.

Supply Control Method of Mixed Rolling Oil

Next, a supply control method of mixed rolling oil that is to be used by a supply control unit (control method of a mix ratio) will be described with reference to FIG. 2.

Figure 2:
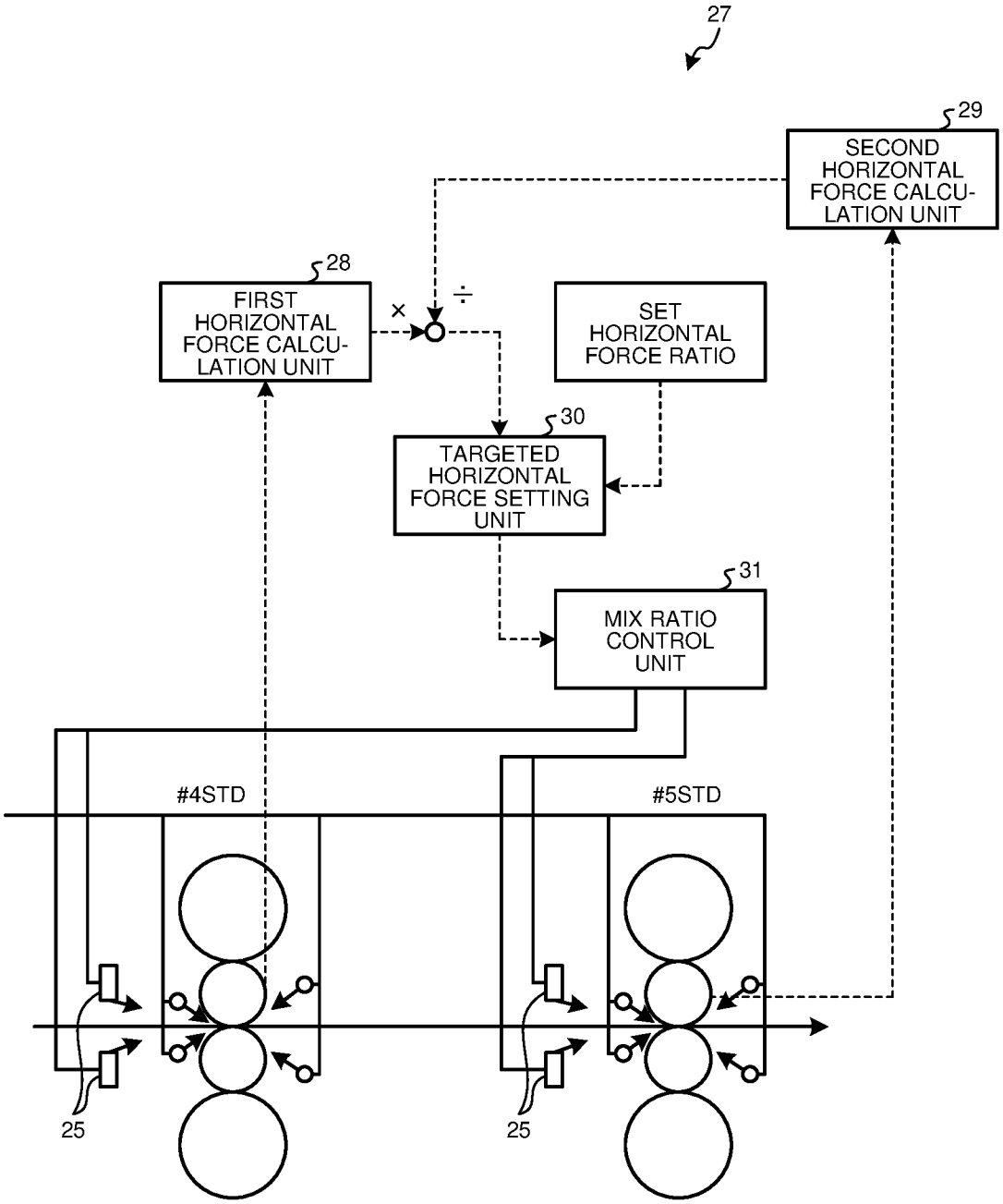
FIG. 2 is a schematic diagram illustrating a configuration of a supply control unit being an embodiment of the present invention.

FIG. 2 is a schematic diagram illustrating a configuration of a supply control unit being an embodiment of the present invention. Note that the supply control unit 27 is configured to, in a case where horizontal vibration is detected in one rolling stand or two neighboring rolling stands, suppress the occurrence of a plate thickness variation of the steel plate S that is attributed to the horizontal vibration. Hereinafter, using an example case where horizontal vibration is detected in the fifth rolling stand, a case where horizontal vibration is detected in one rolling stand will be described as first and second control methods.

First Control Method

As illustrated in FIG. 2, the supply control unit 27 includes a first horizontal force calculation unit 28, a second horizontal force calculation unit 29, a targeted horizontal force setting unit 30, and a mix ratio control unit 31. Note that the supply control unit 27 may be incorporated into a cold tandem mill, or may be incorporated into an operation board connected with a cold tandem mill wirelessly or via a cable. Here, the operation board is an operation member to be used when an operator itself sets a rolling condition and the like that are to be used by the cold tandem mill. In addition, generally, the horizontal vibration easily occurs in a subsequent stage of a cold tandem mill having a relatively-high rolling speed and relatively-high rolling load. Thus, in the present embodiment, the first horizontal force calculation unit 28 and the second horizontal force calculation unit 29 are respectively provided for the fourth and the fifth rolling stands, but a configuration is not limited to this, and the first horizontal force calculation unit 28 and the second horizontal force calculation unit 29 may be provided for all rolling stands.

In the first control method, the first horizontal force calculation unit 28 calculates horizontal force in the fourth rolling stand (neighboring rolling stand #4STD). The fourth rolling stand constitutes an upstream side rolling stand by neighboring the last rolling stand. The first horizontal force calculation unit 28 measures horizontal force acting in a rolling direction of a roll, from a sensor or a load cell that is incorporated in a roll chock, a housing, a project block, or the like, for example.

Similarly to the first horizontal force calculation unit 28, the second horizontal force calculation unit 29 calculates horizontal force in the fifth rolling stand from a rolling result in the fifth rolling stand (last rolling stand #5STD). Note that information acquisition for the calculation of horizontal force is performed when rolling is started in the fifth rolling stand by the steel plate S being bitten into the fifth rolling stand.

Here, among horizontal forces in the rolling stands, horizontal force in the fourth rolling stand is horizontal vibration so weak that the plate thickness of the steel plate S is not affected that is calculated from a past rolling result (vibration smaller than a predetermined first threshold associated with the fourth rolling stand that is identified based on the past rolling result). In addition, horizontal force in the fifth rolling stand is horizontal vibration affecting the plate thickness of the steel plate S that is calculated from a past rolling result (vibration larger than a predetermined second threshold associated with the fifth rolling stand that is identified based on the past rolling result).

In this case, the supply control unit 27 suppresses a plate thickness variation of the steel plate S that is attributed to horizontal vibration, by supplying mixed rolling oil to the fifth rolling stand. Specifically, the targeted horizontal force setting unit 30 calculates a ratio (horizontal force ratio F2/F1) between horizontal force F2 calculated by the first horizontal force calculation unit 28, and horizontal force F1 calculated by the second horizontal force calculation unit 29. Then, the targeted horizontal force setting unit 30 compares the calculated horizontal force ratio F2/F1 and a targeted horizontal force ratio (set horizontal force ratio), and transmits a difference (deviation) therebetween to the mix ratio control unit 31 as a feedback control amount. Note that the targeted horizontal force ratio is preferably set within the range of 0.6 or more and 1.4 or less.

If the horizontal force ratio F2/F1 exceeds the above-described range, a tension variation between rolling stands in the fifth rolling stand and the fourth rolling stand is destabilized, and chattering becomes more likely to occur due to dispersion. The targeted horizontal force ratio is not limited to a specific value within the range of 0.6 to 1.4, but from the viewpoint of prevention of a variation in concentration of rolling oil collected by the oil pan 10, among values within the range of the horizontal force ratio, a horizontal force ratio at which a supply amount of the second emulsion rolling oil 15 with respect to the first emulsion rolling oil 13 becomes the smallest is set as a targeted horizontal force ratio.

The mix ratio control unit 31 obtains a rolling oil mix ratio of the first emulsion rolling oil 13 and the second emulsion rolling oil 15 to be supplied to an input side of the fifth rolling stand, in such a manner that the horizontal force ratio F2/F1 falls within a targeted range, and supplies a command of the obtained mix ratio to the flow rate control valve 17 of the fifth rolling stand.

Second Control Method

The second control method is basically similar to the first control method, but a comparison target of a horizontal force ratio differs from that in the first control method. More specifically, in the first control method, the flow rate control valve 17 is controlled in such a manner that a horizontal force ratio between the fifth rolling stand in which horizontal vibration affecting the plate thickness of the steel plate S occurs, and the fourth rolling stand arranged on the upstream side of the fifth rolling stand with neighboring the fifth rolling stand falls within a predetermined range. In contrast to this, in the second control method, the flow rate control valve 17 of the fifth rolling stand is controlled in such a manner that a ratio (horizontal force ratio F3/F1) between current horizontal force F1 in the fifth rolling stand and targeted horizontal force (i.e., the above-described second threshold) F3 in the fifth rolling stand that is identified from a past rolling result becomes a targeted horizontal force ratio.

Third Control Method

Unlike the first and second control methods, the third control method is configured to, in a case where horizontal vibration is detected in one rolling stand or two neighboring rolling stands, suppress the occurrence of a plate thickness variation of the steel plate S that is attributed to the horizontal vibration. Hereinafter, using an example case where horizontal vibration is detected in the fourth rolling stand and the fifth rolling stand, a case where horizontal vibration is detected in two neighboring rolling stands will be described as the third control method.

More specifically, in a case where horizontal vibration in the fourth rolling stand calculated by the first horizontal force calculation unit 28 has a value larger than a predetermined first threshold (large vibration), and horizontal vibration in the fifth rolling stand calculated by the second horizontal force calculation unit 29 has a value larger than a predetermined second threshold, the supply control unit 27 suppresses a plate thickness variation of the steel plate S that is attributed to horizontal vibration, by supplying mixed rolling oil to the fourth and fifth rolling stands. Specifically, the targeted horizontal force setting unit 30 transmits a control amount by which horizontal forces in the both rolling stands become equal to or smaller than the respective thresholds, and a horizontal force ratio of the both rolling stands becomes a targeted horizontal force ratio, to the mix ratio control unit 31 as a feedback control amount. Similarly to the second control method, the targeted horizontal force ratio is preferably set within the range of 0.6 or more and 1.4 or less. The mix ratio control unit 31 obtains a mix ratio of the first emulsion rolling oil 13 and the second emulsion rolling oil to be supplied to input sides of the fourth and fifth rolling stands, in such a manner that a horizontal force ratio between the fourth rolling stand and the fifth rolling stand becomes a targeted range, and supplies a command of the obtained mix ratio to the flow rate control valve 17 of the fifth rolling stand.

Fourth Control Method

The fourth control method is basically similar to the third control method, but differs in that a rolling stand to which mixed rolling oil is to be supplied is one rolling stand out of two rolling stands. In other words, as mentioned above, if a concentration of rolling oil collected by the oil pan 10 drastically varies, not only an increase in consumed amount of rolling oil is caused, but also rolling slip caused by excessive lubrication might be induced. To prevent this, even if horizontal vibration affecting the plate thickness of the steel plate S occurs in two rolling stands, if a plate thickness variation of the steel plate S can be suppressed by supplying mixed rolling oil to one rolling stand, it is desirable to supply mixed rolling oil only to one rolling stand.

Thus, in this control method, mixed rolling oil is supplied to a rolling stand in which horizontal force having a large absolute value is detected, among horizontal forces calculated by the first horizontal force calculation unit 28 and the second horizontal force calculation unit 29. In other words, the targeted horizontal force setting unit 30 transmits a control amount by which a horizontal force ratio of the both rolling stands becomes a targeted horizontal force ratio, to the mix ratio control unit 31 as a feedback control amount. The mix ratio control unit 31 obtains a rolling oil mix ratio of the first emulsion rolling oil 13 and the second emulsion rolling oil 15 to be supplied to an input side of the fifth rolling stand, in such a manner that a horizontal force ratio between the fourth rolling stand and the fifth rolling stand becomes a targeted range, and supplies a command of the obtained mix ratio to the flow rate control valve 17 of the fifth rolling stand.

Figure 3:
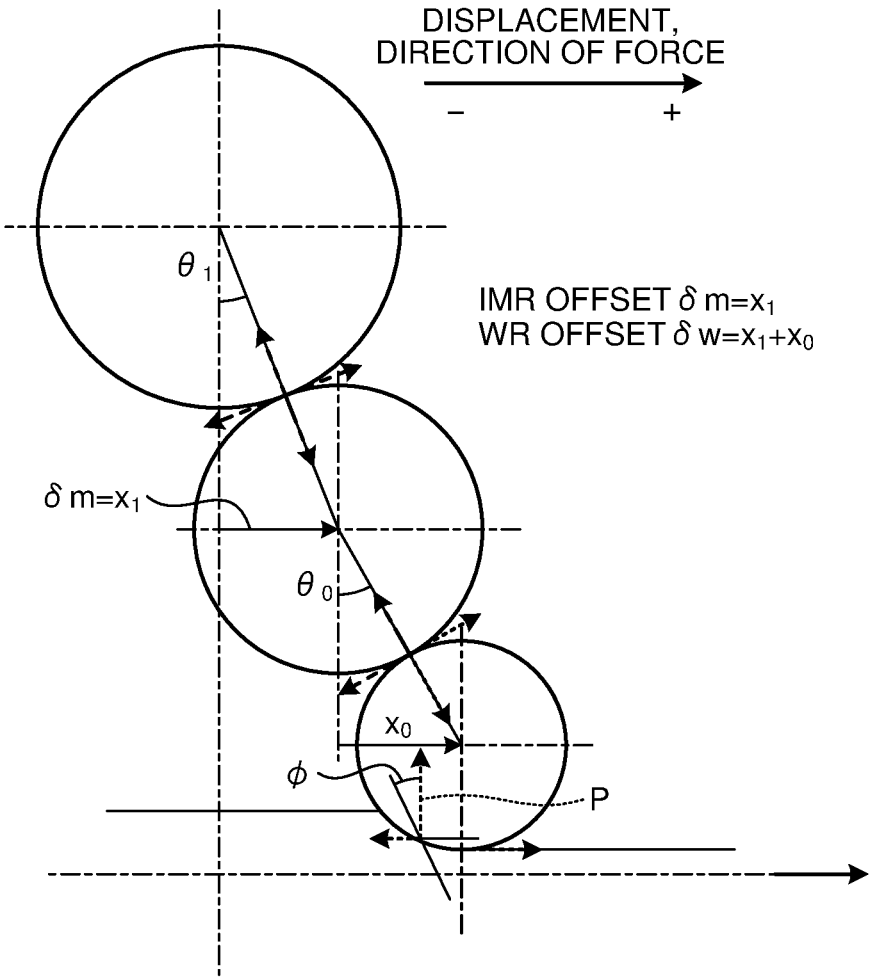
FIG. 3 is a diagram for describing a calculation method of horizontal force.

Note that, in the calculation of horizontal force in a rolling stand, horizontal force may be actually measured as described above, or may be calculated based on a rolling result. In the case of calculating horizontal force based on a rolling result, as illustrated in FIG. 3, horizontal force can be calculated by combining forces acting on rolls of a rolling stand. For example, in a case where upper and lower roll positions are targeted in a 6-high rolling stand, horizontal force Fw acting on a work roll at the time of steady rolling is calculated using the following formulae (1) to (4).

$$F_W = F_{OW} + F_{TW} + F_{FW} \tag{1}$$

$$F_{OW} = P\frac{x_0}{\sqrt{(R_I + R_W)^2 + x_0^2}} \tag{2}$$

$$F_{TW} = \frac{T_f - T_b}{2} \tag{3}$$

$$F_{FW} = \mu\frac{P}{\cos\theta_1}\cdot\frac{d_B}{D_B} \tag{4}$$

Here, $F_{OW}$ denotes horizontal force exerted due to 10 roll offset, $F_{TW}$ denotes force exerted due an input-output side tension difference, $F_{FW}$ denotes force generated by bearing resistance, P denotes rolling force, $x_0$ denotes an offset amount with an intermediate roll (IMR), $R_I$ denotes an IMR roll diameter, $R_W$ denotes a work roll (WR) roll diameter, $T_f$ denotes front tension, $T_b$ denotes back tension, μ denotes a bearing inner friction coefficient, $\theta_1$ denotes an offset angle between a backup roll (BUR) and the IMR, $d_B$ denotes a BUR bearing inner diameter, and $D_B$ denotes a BUR diameter.

Note that a roll from which horizontal force is calculated is not limited, but it is desirable that the roll is an intermediate roll or a work roll. In addition, respective horizontal forces of upper and lower rolls may be used, or horizontal force may be calculated only from one roll of upper and lower rolls. In addition, in a case where chattering is unlikely to occur, such as a case where rolling is performed using a soft material not causing lubrication insufficiency, as a rolling object material, a case where rolling is performed at low speed, or a case where rolling is performed in an acceleration and deceleration unit, adjustment of rolling oil needs not be performed by feedback control. In other words, in a case where chattering is unlikely to occur, a mix ratio set for each operation condition, or a mix ratio common to all operation conditions under which chattering does not occur may be used, and a similar effect is obtained even if feedback control is executed only in a case where an operation condition under which chattering easily occurs is caused.

In addition, the number of rolling stands (mix target stands) to which mixed rolling oil obtained by mixing the second emulsion rolling oil 15 is to be supplied may be three or more. In a case where the lubrication coolant headers 25 are provided on the respective input sides of three or more rolling stands, the flow rate control valve 17 may be provided for each rolling stand, or one flow rate control valve 17 may be provided for a plurality of rolling stands. For example, one flow rate control valve 17 may be provided for the last (fifth) rolling stand, and one common flow rate control valve 17 may be provided for the third and fourth rolling stands. In this case, as for a horizontal force ratio, it is sufficient that a horizontal force ratio between the third rolling stand and the fourth rolling stand, and a horizontal force ratio between the fourth rolling stand and the fifth rolling stand fall within the range of a targeted horizontal force ratio. In addition, a rolling stand to which mixed rolling oil is to be supplied needs not include the last rolling stand. In addition, the number of rolling stands in a cold tandem mill is not limited to five, and a cold tandem mill including four or less rolling stands or six or more rolling stands may be used.

In addition, in the above-described embodiment, horizontal vibration is detected and calculated, and the mix ratio control unit 31 controls the flow rate control valve 17 in accordance with the result, and sets a rolling oil mix ratio of the first emulsion rolling oil 13 and the second emulsion rolling oil 15 to an appropriate mix ratio, but an appropriate mix ratio may be displayed on a display screen (not illustrated) or the like, and an operation of the flow rate control valve 17 may be performed by an operator. By the flow rate control valve 17 being controlled by the operator, it is possible to adjust a rolling oil mix ratio of the first emulsion rolling oil 13 and the second emulsion rolling oil 15 at operator's discretion within the range of appropriate horizontal force ratios.

EXAMPLE

Hereinafter, the present invention will be described based on examples.

In this example, using the cold tandem mill illustrated in FIG. 1, a raw material steel plate for a magnetic steel plate that contains 2.5 mass % Si and 3 mass % Si with a based material thickness of 2.0 mm and a plate width of 1000 mm is used as a rolling object material, and the steel plate was rolled up to a finish thickness of 0.300 mm at targeted rolling speeds of 200 mpm, 600 mpm, 800 mpm, and 1000 mpm. Here, it is known that the raw material steel plate for a magnetic steel plate is hard, and chattering easily occurs in a case where high-load rolling is performed at low rolling speed or the like. As undiluted solution of rolling oil, undiluted solution obtained by adding an oil-based agent and an antioxidizing agent each by 1 mass % to base oil to which vegetable oil and fat are added to synthetic ester oil, and adding a non-ionic surfactant by 3 mass % at an oil concentration as a surfactant was used. As the first emulsion rolling oil 13 supplied from the first rolling oil supply system 2 and cyclically used, emulsion rolling oil with a rolling oil concentration of 3.5 mass %, an average particle diameter of 5 μm, and a temperature of 55° C. was prepared.

Example 1 and Comparative Example 1

In Example 1, the above-described raw material containing 2.5 mass % Si was used as a rolling object material, horizontal force on a work roll in the fifth rolling stand was calculated, and based on a ratio with a past horizontal force result in which chattering has not occurred in the fifth rolling stand, emulsion rolling oils supplied from the first rolling oil supply system 2 and the second rolling oil supply system 14 were mixed. A targeted horizontal force ratio was set in such a manner that a ratio between a past horizontal force result of the fifth rolling stand and horizontal force in the fifth rolling stand becomes 0.6 or more and 1.4 or less. On the other hand, in Comparative Example 1, a targeted horizontal force ratio was set in such a manner that a ratio between horizontal forces in the fourth rolling stand and the fifth rolling stand becomes 1.4 or more.

Example 2 and Comparative Example 2

In Example 2, the above-described raw material containing 2.5 mass % Si was used as a rolling object material, horizontal forces on work rolls in the fourth and fifth rolling stands were calculated, and based on a calculated horizontal force ratio, emulsion rolling oils supplied from the first rolling oil supply system 2 and the second rolling oil supply system 14 were mixed. A targeted horizontal force ratio was set in such a manner that a ratio between horizontal forces in the fourth and fifth rolling stands becomes 0.6 or more and 1.4 or less. On the other hand, in Comparative Example 2, a targeted horizontal force ratio was set in such a manner that a ratio between horizontal forces in the fourth and fifth rolling stands becomes a value less than 0.6.

Example 3 and Comparative Example 3

In Example 3, a raw material containing 3.0 mass % Si was used as a rolling material, horizontal forces on work rolls in the fourth and fifth rolling stands were calculated, and based on a calculated horizontal force ratio, emulsion rolling oils supplied from the first rolling oil supply system 2 and the second rolling oil supply system 14 were mixed. A targeted horizontal force ratio was set in such a manner that a ratio between horizontal forces in the fourth and fifth rolling stands becomes 0.6 or more and 1.4 or less. On the other hand, in Comparative Example 3, a targeted horizontal force ratio was set in such a manner that a ratio between horizontal forces in the fourth and fifth rolling stands becomes 1.4 or more.

Example 4 and Comparative Example 4

In Example 4, a raw material containing 3.0 mass % Si was used as a rolling material, horizontal forces on work rolls in the fourth and fifth rolling stands were calculated, and based on a calculated horizontal force ratio, emulsion rolling oils supplied from the first rolling oil supply system 2 and the second rolling oil supply system 14 were mixed. A targeted horizontal force ratio was set in such a manner that a ratio between horizontal force in the fourth rolling stand and horizontal force in the fifth rolling stand becomes 0.6 or more and 1.4 or less. On the other hand, in Comparative Example 4, a targeted horizontal force ratio was set in such a manner that a ratio between horizontal force in the fourth rolling stand and horizontal force in the fifth rolling stand becomes a value less than 0.6.

Evaluation

By performing the above-described rolling oil supply, a ratio of horizontal forces that have acted on work rolls in the fourth rolling stand and the fifth rolling stand in a case where low-speed to high-speed rollings were executed in each example and comparative example and an occurrence status of chattering were checked. The result is indicated in the following table 1. Note that ○, Δ, and x in the table indicate the following statues.

○: No chattering occurrence over the coil entire length

Δ: Mild degree of chattering occurrence in a part of the coil entire length (minute plate thickness variation occurred)

x: Chattering occurrence (excessive plate thickness variation occurred)

As illustrated in Table 1, in cold rolling for a steel plate with a Si contained amount of 2.5 mass %, it was confirmed that chattering occurrence can be suppressed by mixing emulsion rolling oils supplied from the first rolling oil supply system 2 and the second rolling oil supply system 14, in such a manner that a ratio between current horizontal force on a work roll in a rolling stand and a result value of past horizontal force in which chattering has not occurred becomes 0.6 or more and 1.4 or less (Example 1).

In addition, in cold rolling for a steel plate with a Si contained amount of 2.5 mass %, it was confirmed that chattering occurrence can be suppressed by mixing emulsion rolling oils supplied from the first rolling oil supply system 2 and the second rolling oil supply system 14, in such a manner that a horizontal force ratio on work rolls in the fourth rolling stand and the fifth rolling stand becomes 0.6 or more and 1.4 or less (Example 2). Furthermore, it was confirmed that chattering occurrence can be similarly suppressed also in a high-strength magnetic steel plate with a Si contained amount of 3 mass % (Examples 3 and 4).

In contrast to this, it was confirmed that, in a case where a horizontal force ratio falls below 0.6 or exceeds 1.4, chattering occurred heavily, and surface quality and plate thickness accuracy declined (Comparative Examples 1 to 4).

From the above points, it was confirmed that, by using a lubricating oil supply method that is based on the present invention, even in a wide range of rolling speed and deformation resistance, roll horizontal force acting in a rolling direction in a subsequent rolling stand can be continuously kept in an adequate range, and it is possible to stably manufacture a steel plate having high productivity, a good shape, and plate thickness accuracy.

TABLE 1

| | Fourth rolling stand horizontal force ratio | Fifth rolling stand horizontal force ratio | Mixed rolling oil-supplied stand | Horizontal force ratio acting on work roll | 200 mpm | 600 mpm | 800 mpm | 1000 mpm |
|---|---|---|---|---|---|---|---|---|
| Example 1 | Within first threshold | Exceed second threshold | Fifth rolling stand | Fifth rolling stand (past result)/fifth rolling stand chattering | 1.05 ○ | 1.15 ○ | 1.08 ○ | 1.10 ○ |
| Example 2 | Within first threshold | Exceed second threshold | Fifth rolling stand | Fourth rolling stand/ fifth rolling stand chattering | 1.25 ○ | 1.35 ○ | 1.15 ○ | 1.20 ○ |
| Example 3 | Exceed first threshold | Exceed second threshold | Fourth and fifth rolling stands | Fourth rolling stand/ fifth rolling stand chattering | 1.10 ○ | 1.05 ○ | 1.00 ○ | 0.95 ○ |
| Example 4 | Exceed first threshold | Exceed second threshold | Fifth rolling stand | Fourth rolling stand/ fifth rolling stand chattering | 1.31 ○ | 1.32 ○ | 1.28 ○ | 1.30 ○ |
| Comparative Example 1 | Within first threshold | Exceed second threshold | Fifth rolling stand | Fifth rolling stand (past result)/fifth rolling stand chattering | 1.42 Δ | 1.47 X | 1.43 X | 1.49 X |
| Comparative Example 2 | Within first threshold | Exceed second threshold | Fifth rolling stand | Fourth rolling stand/ fifth rolling stand chattering | 0.55 Δ | 0.58 X | 0.57 X | 0.53 X |
| Comparative Example 3 | Exceed first threshold | Exceed second threshold | Fifth rolling stand | Fourth rolling stand/ fifth rolling stand chattering | 1.52 Δ | 1.43 X | 1.46 X | 1.48 X |
| Comparative Example 4 | Exceed first threshold | Exceed second threshold | Fourth and fifth rolling stands | Fourth rolling stand/ fifth rolling stand chattering | 0.52 Δ | 0.56 X | 0.57 X | 0.53 X |

Heretofore, an embodiment to which the invention devised by these inventors is applied has been described, but the present invention is not to be limited by the description and the drawings that constitute a part of the disclosure of the present invention according to the present embodiment. In other words, another embodiment, examples, and operating techniques that are devised by the one skilled in the art or the like based on the present embodiment are all included in the scope of the present invention.

INDUSTRIAL APPLICABILITY

According to the present invention, it is possible to provide a cold rolling facility and a cold rolling method that can suppress the occurrence of chattering in the horizontal direction. In addition, according to the present invention, it is possible to provide a manufacturing method of a metal plate that can manufacture a metal plate with a good yield ratio.

REFERENCE SIGNS LIST

2 FIRST ROLLING OIL SUPPLY SYSTEM
3 LUBRICATION COOLANT HEADER
4 COOLING COOLANT HEADER
5 DIRTY TANK (COLLECTION TANK)
6 IRON POWDER REMOVAL DEVICE
7 CLEAN TANK (STORAGE TANK)
8 PUMP
9 FIRST ROLLING OIL PIPE LINE
10 OIL PAN
11 RETURN PIPE
13 FIRST EMULSION ROLLING OIL
14 SECOND ROLLING OIL SUPPLY SYSTEM
15 SECOND EMULSION ROLLING OIL
16 SECOND ROLLING OIL PIPE LINE
17 FLOW RATE CONTROL VALVE (MIXING UNIT)
18 PUMP
19 EMULSION TANK
20 AGITATOR
21 FLOW RATE CONTROL VALVE
22 ROLLING OIL CRUDE OIL TANK
23 WARM WATER TANK
24 THIRD ROLLING OIL PIPE LINE
25 LUBRICATION COOLANT HEADER
26 MIXED ROLLING OIL PIPE LINE
27 SUPPLY CONTROL UNIT
28 FIRST HORIZONTAL FORCE CALCULATION UNIT
29 SECOND HORIZONTAL FORCE CALCULATION UNIT
30 TARGETED HORIZONTAL FORCE SETTING UNIT
31 MIX RATIO CONTROL UNIT
S STEEL PLATE

The invention claimed is:

1. A cold rolling facility comprising:
a cold tandem mill including a plurality of rolling stands;
a supply controller; and
a rolling supply system configured to supply rolling oil to the cold tandem mill,
wherein the rolling supply system includes
a first rolling oil supply system that includes:
a first rolling oil pipe line having one end portion connected to a clean tank; and
a lubrication coolant header and a cooling coolant header that are branched at another end portion of the first rolling oil pipe line, the first rolling oil supply system being configured to supply first emulsion rolling oil, and
a second rolling oil supply system that includes:
a second rolling oil pipe line having one end portion connected to the first rolling oil pipe line;
a third rolling oil pipe line having one end portion connected to an emulsion tank;
a flow rate control valve connected to the second rolling oil pipe line and the third rolling oil pipe line, the flow rate control valve being configured to form mixed rolling oil in accordance with a command from the supply controller;

a lubrication coolant header; and a mixed rolling oil pipe line having one end connected to the flow rate control valve and another end connected to the lubrication coolant header, the second rolling oil supply system being configured to supply second emulsion rolling oil having a higher concentration than the first emulsion rolling oil, and wherein the supply controller is configured to supply the mixed rolling oil obtained by mixing the first emulsion rolling oil and the second emulsion rolling oil at least to a specific rolling stand among the plurality of rolling stands in such a manner as to satisfy the following formula (1), $$0.6 \leq F2/F1 \leq 1.4 \quad (1),$$

where F1 denotes first horizontal force acting in a rolling direction on a roll included in the specific rolling stand, and F2 denotes second horizontal force acting in a rolling direction on a roll included in an upstream side rolling stand arranged on an upstream side of the specific rolling stand and neighboring with the specific rolling stand.

2. The cold rolling facility according to claim 1, wherein, in a case where the first horizontal force and the second horizontal force both exceed a predetermined standard value, the mixed rolling oil is supplied to both of the specific rolling stand and the upstream side rolling stand, and wherein, in a case where only the first horizontal force exceeds a predetermined standard value out of the first horizontal force and the second horizontal force, the mixed rolling oil is supplied to the specific rolling stand, and the mixed rolling oil is not supplied to the upstream side rolling stand.

3. The cold rolling facility according to claim 1, wherein, in a case where the first horizontal force and the second horizontal force both exceed a predetermined standard value, and in a case where only the first horizontal force exceeds a predetermined standard value out of the first horizontal force and the second horizontal force, the mixed rolling oil is supplied to the specific rolling stand, and the mixed rolling oil is not supplied to the upstream side rolling stand.

4. A cold rolling facility comprising:

a cold tandem mill including a plurality of rolling stands;

a supply controller; and a rolling supply system configured to supply rolling oil to the cold tandem mill, wherein the rolling supply system includes a first rolling oil supply system that includes:

a first rolling oil pipe line having one end portion connected to a clean tank; and a lubrication coolant header and a cooling coolant header that are branched at another end portion of the first rolling oil pipe line, the first rolling oil supply system being configured to supply first emulsion rolling oil, and a second rolling oil supply system that includes:

a second rolling oil pipe line having one end portion connected to the first rolling oil pipe line;

a third rolling oil pipe line having one end portion connected to an emulsion tank;

a flow rate control valve connected to the second rolling oil pipe line and the third rolling oil pipe line, the flow rate control valve being configured to form mixed rolling oil in accordance with a command from the supply controller;

a lubrication coolant header; and a mixed rolling oil pipe line having one end connected to the flow rate control valve and another end connected to the lubrication coolant header, the second rolling oil supply system being configured to supply second emulsion rolling oil having a higher concentration than the first emulsion rolling oil, and wherein the supply controller is configured to supply the mixed rolling oil obtained by mixing the first emulsion rolling oil and the second emulsion rolling oil at least to a specific rolling stand among the plurality of rolling stands in such a manner as to satisfy the following formula (2), $$0.6 \leq F3/F1 \leq 1.4 \quad (2),$$

where F1 denotes first horizontal force acting in a rolling direction on a roll included in the specific rolling stand, and F3 denotes third horizontal force identified based on a past rolling result of the specific rolling stand.

5. A method for cold-rolling a rolling object material, the method comprising:

providing a cold rolling facility comprising:

a cold tandem mill including a plurality of rolling stands;

a supply controller; and a rolling supply system configured to supply rolling oil to the cold tandem mill, wherein the rolling supply system includes a first rolling oil supply system that includes:

a first rolling oil pipe line having one end portion connected to a clean tank; and a lubrication coolant header and a cooling coolant header that are branched at another end portion of the first rolling oil pipe line, the first rolling oil supply system being configured to supply first emulsion rolling oil, and a second rolling oil supply system that includes:

a second rolling oil pipe line having one end portion connected to the first rolling oil pipe line;

a third rolling oil pipe line having one end portion connected to an emulsion tank;

a flow rate control valve connected to the second rolling oil pipe line and the third rolling oil pipe line, the flow rate control valve being configured to form mixed rolling oil in accordance with a command from the supply controller;

a lubrication coolant header; and a mixed rolling oil pipe line having one end connected to the flow rate control valve and another end connected to the lubrication coolant header, the second rolling oil supply system being configured to supply second emulsion rolling oil having a higher concentration than the first emulsion rolling oil, cold-rolling the rolling object with the cold rolling facility; and supplying the mixed rolling oil obtained by mixing the first emulsion rolling oil and the second emulsion rolling oil at least to a specific rolling stand among the plurality of rolling stands in such a manner as to satisfy:

option A) the following formula (1), $$0.6 \leq F2/F1 \leq 1.4 \quad (1),$$

where F1 denotes first horizontal force acting in a rolling direction on a roll included in the specific rolling stand, and F2 denotes second horizontal force acting in a rolling direction on a roll included in an upstream side rolling stand arranged on an upstream side of the specific rolling stand and neighboring with the specific rolling stand; or option B) the following formula (2), $$0.6 \leq F3/F1 \leq 1.4 \quad (2),$$

where F3 denotes third horizontal force identified based on a past rolling result of the specific rolling stand.

6. A manufacturing method of a metal plate, the method comprising:

providing a cold rolling facility comprising:

a cold tandem mill including a plurality of rolling stands;

a supply controller; and a rolling supply system configured to supply rolling oil to the cold tandem mill, wherein the rolling supply system includes a first rolling oil supply system that includes:

a first rolling oil pipe line having one end portion connected to a clean tank; and a lubrication coolant header and a cooling coolant header that are branched at another end portion of the first rolling oil pipe line, the first rolling oil supply system being configured to supply first emulsion rolling oil, and a second rolling oil supply system that includes:

a second rolling oil pipe line having one end portion connected to the first rolling oil pipe line;

a third rolling oil pipe line having one end portion connected to an emulsion tank;

a flow rate control valve connected to the second rolling oil pipe line and the third rolling oil pipe line, the flow rate control valve being configured to form mixed rolling oil in accordance with a command from the supply controller;

a lubrication coolant header; and a mixed rolling oil pipe line having one end connected to the flow rate control valve and another end connected to the lubrication coolant header, the second rolling oil supply system being configured to supply second emulsion rolling oil having a higher concentration than the first emulsion rolling oil, cold-rolling a rolling object material into the metal plate with the cold rolling facility; and supplying the mixed rolling oil obtained by mixing the first emulsion rolling oil and the second emulsion rolling oil at least to a specific rolling stand among the plurality of rolling stands in such a manner as to satisfy:

option A) the following formula (1), $$0.6 \leq F2/F1 \leq 1.4 \quad (1),$$

where F1 denotes first horizontal force acting in a rolling direction on a roll included in the specific rolling stand, and F2 denotes second horizontal force acting in a rolling direction on a roll included in an upstream side rolling stand arranged on an upstream side of the specific rolling stand and neighboring with the specific rolling stand; or option B) the following formula (2), $$0.6 \leq F3/F1 \leq 1.4 \quad (2),$$

where F3 denotes third horizontal force identified based on a past rolling result of the specific rolling stand.

* * * * *